US005443049A

United States Patent [19]

Wall

[11] Patent Number: 5,443,049

[45] Date of Patent: Aug. 22, 1995

[54] FUEL PUMPING APPARATUS

[75] Inventor: Robin C. Wall, Rochester, England

[73] Assignee: Lucas Industries Public Limited Company, England

[21] Appl. No.: 256,912

[22] PCT Filed: Jan. 29, 1993

[86] PCT No.: PCT/GB93/00193

§ 371 Date: Aug. 2, 1994

§ 102(e) Date: Aug. 2, 1994

[87] PCT Pub. No.: WO93/17236

PCT Pub. Date: Sep. 2, 1993

[30] Foreign Application Priority Data

Feb. 19, 1992 [GB] United Kingdom ..... 9203636

[51] Int. Cl.[6] ..... F02M 41/14; F02M 63/02

[52] U.S. Cl. ..... 123/458; 123/506

[58] Field of Search ..... 123/458, 506

[56] References Cited

U.S. PATENT DOCUMENTS

| | | | |
|---|---|---|---|
| 3,841,286 | 10/1974 | Eheim . | |
| 3,977,649 | 8/1976 | Zeuner et al. | 251/82 |
| 4,681,080 | 7/1987 | Schukoff | 123/506 |
| 4,763,873 | 8/1988 | Phillips | 123/506 |
| 4,832,312 | 5/1989 | Linder et al. | 123/458 |
| 4,840,155 | 6/1989 | Karle | 123/506 |
| 5,007,400 | 4/1991 | Babitzka | 123/506 |
| 5,150,688 | 9/1992 | Nothdurft et al. | 123/506 |
| 5,347,970 | 9/1994 | Pape et al. | 123/506 |
| 5,373,828 | 12/1994 | Asken et al. | 123/506 |

*Primary Examiner*—Thomas N. Moulis

*Attorney, Agent, or Firm*—Andrus, Sceales, Starke & Sawall

[57] ABSTRACT

A fuel injection pumping apparatus of the rotary distributor type includes a pumping plunger (13) housed in a bore which is completely filled with fuel during the filling stroke of the apparatus. An electromagnetically operable spill valve (22) is provided to control the quantity of fuel supplied by the apparatus during the delivery stroke of the plunger. The spill valve is spring biased to the open position and is closed by an actuating member (42). If the spill valve sticks in the closed position the maximum amount of fuel will be supplied to the associated engine at each delivery stroke. A flow inhibit valve (35) is provided to control fuel flow to the bore. The flow inhibit valve is responsive to the position of the actuating member of the valve and will move to the closed position in the event that the spill valve remains in the closed position.

5 Claims, 2 Drawing Sheets

FUEL PUMPING APPARATUS

Figure 1:
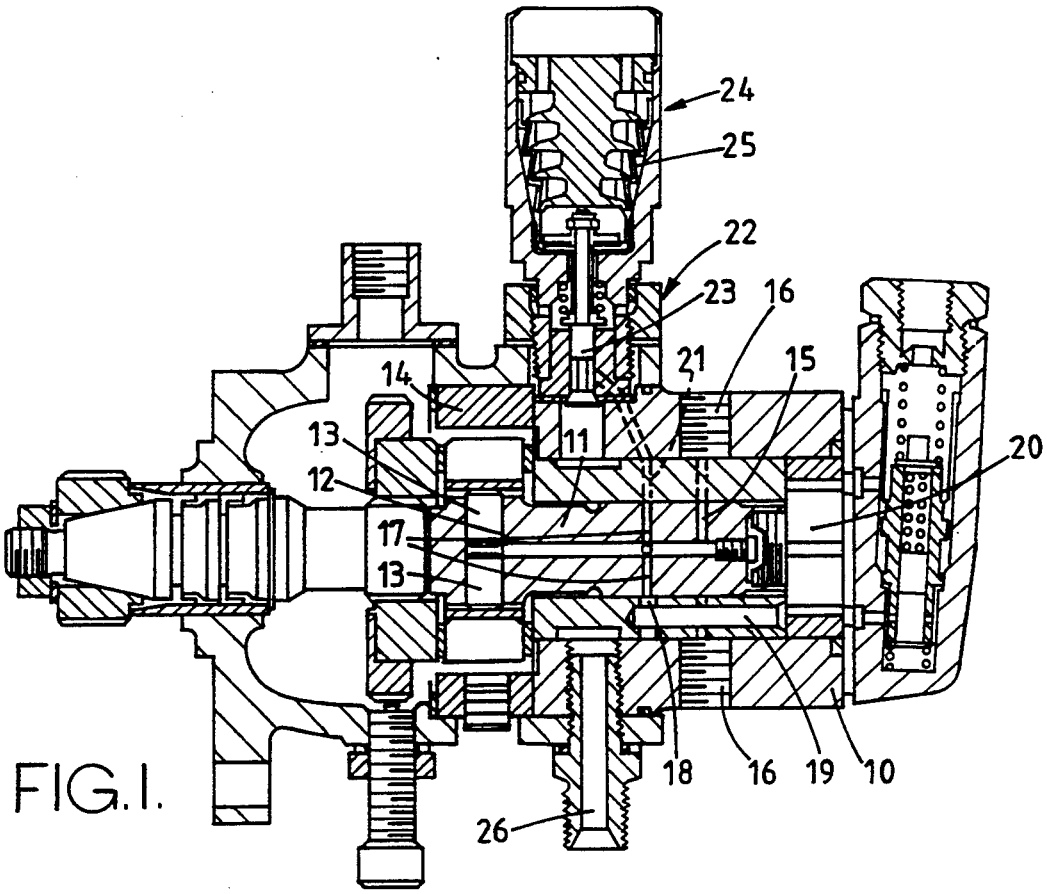

This invention relates to a fuel injection pumping apparatus for supplying fuel to a compression ignition engine and of the kind comprising a bore, a pumping plunger reciprocable within the bore, the plunger and bore defining a pumping chamber, an outlet passage communicating with the pumping chamber and through which during inward movement of the pumping plunger, fuel can be displaced to an associated engine, passage means through which fuel from a source of fuel under pressure can flow into the pumping chamber to completely fill the pumping chamber during outward movement of the pumping plunger and an electromagnetically operable spill valve including an actuating member, for spilling fuel from the pumping chamber during the inward movement of the pumping plunger thereby to control the quantity of fuel supplied to the associated engine.

One example of such an apparatus is seen in GB-A-2119030 and in the apparatus shown therein a high pressure pump comprising a pair of pumping plungers delivers fuel to a plurality of outlet ports in turn. A single spill valve is utilized to control the quantity of fuel delivered through the outlet ports to the combustion chambers of the aforesaid engine.

The spill valve includes a valve member which is spring loaded to the open position, the valve member being moved to the closed position when the solenoid of the associated actuator is supplied with electric current. The solenoid is energised during the inward movement of the pumping plungers and may be de-energised before the inward movement is completed, in order to control the amount of fuel delivered to the engine. If the spill valve for some reason remains closed, then all the fuel previously supplied to the pumping chamber will be delivered to the engine and as a result the engine will receive considerably more fuel than intended with the possibility of excess engine speed and other damage.

One way of overcoming this problem is to provide the apparatus with a fuel shut off valve which is normally closed and which is located intermediate the high pressure pump and a low pressure fuel supply pump which forms part of the apparatus. A further solenoid is provided which when energised, opens the valve and the supply of electric current to the solenoid can be controlled by the control system of the apparatus. The cost of providing the additional solenoid together with the additional connections to the control system can be substantial.

The object of the present invention is to provide an apparatus of the kind specified in a simple and convenient form.

According to the invention an apparatus of the kind specified comprises a flow inhibit valve incorporated into said passage means, said flow inhibit valve including a valve member movable to a closed position to prevent flow of fuel through said passage means and means movable by said actuating member for controlling the setting of the valve member.

Figure 2:
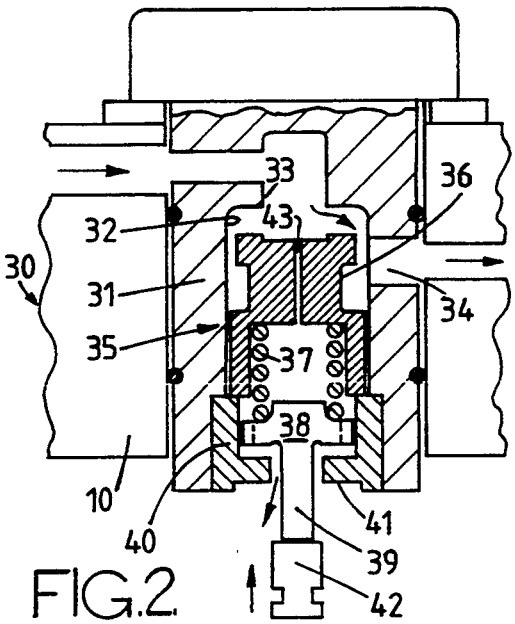
Figure 3:
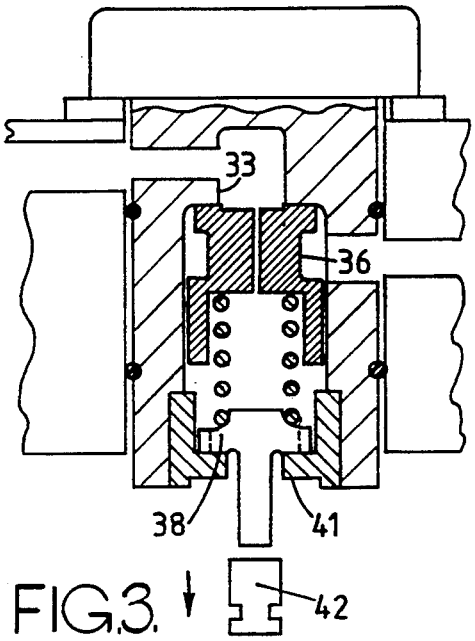
Figure 4:
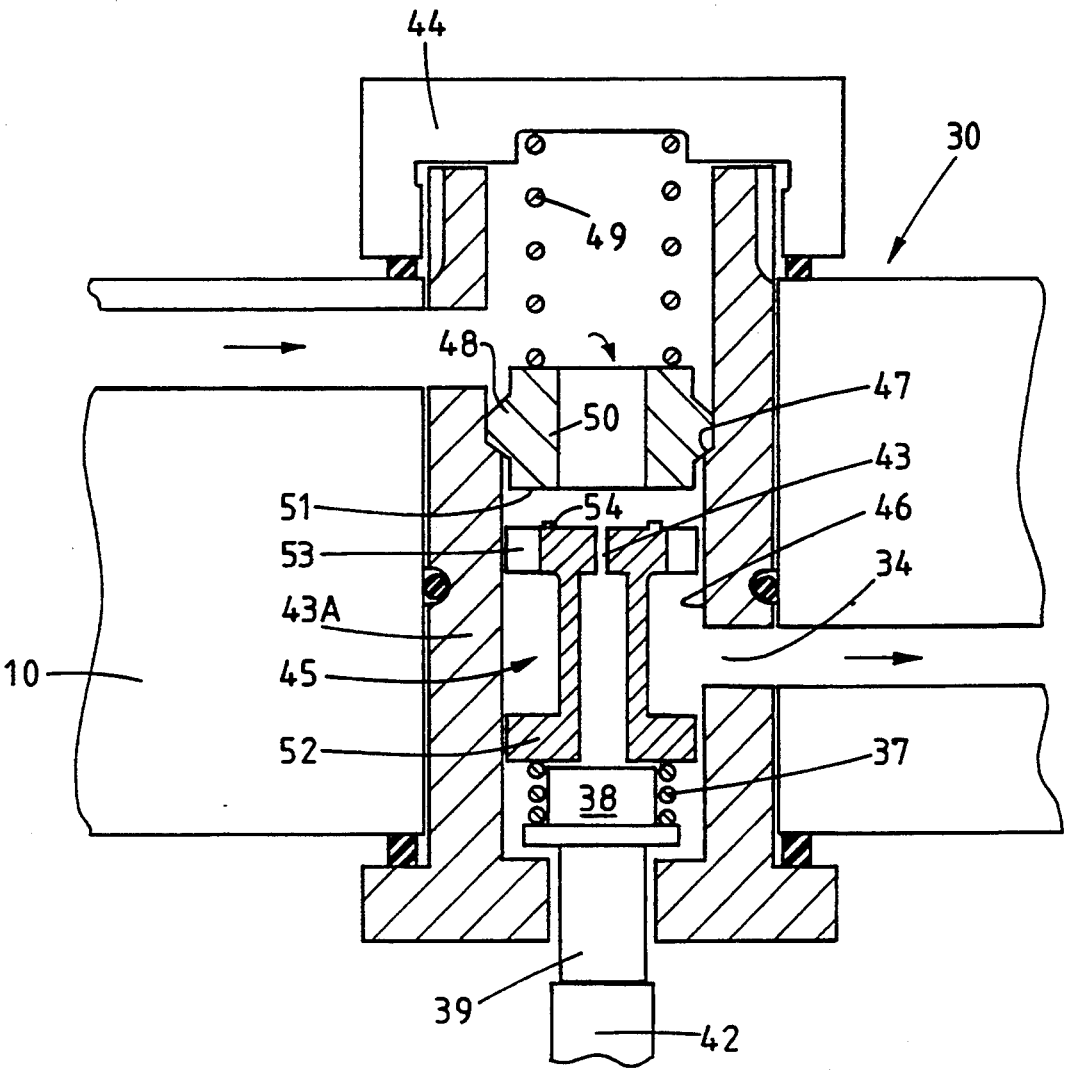

An example of a fuel pumping apparatus in accordance with the invention will now be described with reference to the accompanying drawings in which:

FIG. 1 is a sectional side elevation of an apparatus to which the invention is applied, FIGS. 2 and 3 are diagrammatic drawings of a flow inhibit valve which may be incorporated into the apparatus shown in FIG. 1, the two figures showing the valve in different settings, and FIG. 4 is a view similar to FIG. 2 showing a modified form of the inhibit valve.

Referring to FIG. 1 of the drawings the pumping apparatus includes a housing 10 in which is mounted a rotary distributor member 11 which is driven in synchronism with the associated engine. A transverse bore 12 is formed in the distributor member and in the bore is mounted a pair of pumping plungers 13 which are movable inwardly by the action of cam lobes formed on the internal surface of a cam ring 14 mounted in the housing. The plungers and bore define the pumping chamber of a high pressure pump. The pumping chamber communicates by way of a longitudinal passage in the distributor member, with a delivery passage 15 also in the distributor member and the delivery passage is positioned to register in turn with a plurality of outlet ports 16 formed in the housing and communicating in use with the injection nozzles of the associated engine. The registration of the delivery passage 15 with an outlet port 16 takes place for the whole period the plungers 13 move inwardly and fuel is supplied to the outlet ports in turn.

Also communicating with the longitudinal passage and formed in the distributor member is a plurality of inlet passages 17 which register in turn with an inlet port 18 during the periods when the pumping plungers are allowed to move outwardly by the cam lobes. The inlet port is connected by way of a passage 19 to the outlet of a low pressure fuel supply pump 20 and the flow of fuel through the inlet port and the inlet passage communicating therewith ensures that the pumping plungers 13 are moved outwardly to their maximum extent and that the pumping chamber of the high pressure pump is completely full of fuel prior to the start of inward movement of the plungers.

In order to control the quantity of fuel delivered through the outlet ports 16 to the associated engine it is arranged that one of the inlet passages 17 during the time the plungers are moving inwardly, is in communication with a spill port 21 formed in the housing 10. Flow of fuel through the port 21 is controlled by a spill valve 22 which includes a spill valve member 23 which can be drawn into engagement with a seating by energising an electromagnetic actuator 24. The valve member is spring biased to the open position and is coupled to the armature 25 of the actuator. In the open position of the spill valve 22 and during inward movement of the pumping plungers fuel flows through the spill passage 21 instead of being delivered to the associated engine and the spilled fuel flows to the exterior of the housing through a drain connector 26.

The energisation of the actuator is under the control of an electronic control system which is responsive to a number of actual and desired engine operating parameters and the spill valve can be closed at the start of inward movement of the pumping plungers so that delivery of fuel always takes place at predetermined relative angular positions of the distributor member 11 and cam ring 14 in which case the cam ring is angularly adjustable within the housing to enable the timing of fuel delivery to be adjusted. Alternatively, the closure of the spill valve can be arranged to take place after the inward movement of the pumping plungers has started to provide for variation in the start of fuel delivery to the engine. In both cases the period of closure of the spill valve determines the quantity of fuel supplied to the associated engine.

In the normal operation of the apparatus the amount of fuel delivered to the associated engine will be less than the volume of fuel displaced by the pumping plungers so that if for some reason or other the valve member 23 of the spill valve sticks in the closed position a substantial excess of fuel will be delivered to the associated engine and this will result in an increase in the engine speed beyond its governed maximum speed.

In order to prevent the excessive flow of fuel as mentioned above, there is incorporated into the passage 19 a fuel inhibit valve which is generally indicated at 30 in FIG. 2 and this comprises a valve housing 31 which is secured in the housing 10 of the apparatus. The valve housing is formed with a cylinder 32 having a closed end in which is formed a port 33 which communicates with the low pressure fuel supply pump 20. In the wall of the cylinder is formed a further port 34 which is connected to the port 18. Slidable in the cylinder is a valve member 36 having a piston portion 35 at one end. The valve member 36 is shaped to engage the end of the cylinder so as to close the port 33. The valve member is biased in the direction of port closure by means of a light spring 37 which is partly accommodated within a recess formed in the piston portion and which engages a control element 38 having an integral actuating rod 39 which extends out of the cylinder. Engaged within the open end of the cylinder is an insert 40 having an inwardly directed apertured flange 41 through which the actuating rod 39 extends. The control element 38 together with the inner surface of the flange 41 form a control valve which is shown in the open position in FIG. 2 but in the closed position in FIG. 3.

The actuating rod 39 is engagable by an actuating member 42 which is associated with the valve member 23. In the position in which the actuating member is shown in FIG. 2, the valve member 23 is in the open position whereas in FIG. 3, the actuating member 42 is shown in the position which it adopts when the valve member 23 is in the closed position. The direction of movement of the actuating member 42 in FIGS. 2 and 3 is opposite to that of the valve member 23 shown in FIG. 1. This is not intentional.

When the control element is in engagement with the flange 41 fuel is prevented from escaping from the chamber occupied by the spring 37 and fuel is supplied to this chamber by way of a restricted passage 43 formed in the valve member.

Considering now the setting of the various parts as shown in FIG. 2, this corresponding to the valve member 23 being in the open position. The control element 38 is spaced from the flange so that fuel can escape from the chamber which contains the spring and the piston and valve member are moved against the action of the spring 37, by the fuel under pressure from the source. The result is that the port 33 is open and fuel can flow through this port into the cylinder and then through the port 34 for the purpose of filling the pumping chamber of the high pressure pump. When the valve 23 is closed the control element 38 rests upon the flange so that fuel can no longer escape from the chamber which contains the spring 37. As a result and under the action of the spring, the piston portion 35 and the valve member 36 move upwardly to close the port 33 so that the supply of fuel to the port 18 is prevented. Thus if the valve member 23 remains in the closed position the parts of the inhibit valve 30 will assume the positions shown in FIG. 3 and no fuel will be supplied by the apparatus. The valve member is held in the closed position by the combined action of the spring 37 and the fuel pressure in the portion of the cylinder containing the spring, the area of the piston exposed to this pressure being greater than the area of the valve member exposed to the same pressure.

It is not intended that the piston and valve member of the inhibit valve should move between the extreme positions shown in FIGS. 2 and 3 each time the valve 23 is operated and in practice the piston and valve member will tend particularly at high speeds, to assume an equilibrium position between the two extremes when the apparatus is functioning normally. If the valve 23 remains in the closed position, the piston and valve member will move towards the end of the cylinder quickly enough to prevent fuel flow to the engine within a few cycles of operation of the pumping plungers 13.

An alternative form of the inhibit valve is seen in FIG. 4 in which identical reference numerals to those used in FIGS. 2 and 3 are used when possible. The valve housing comprises a sleeve 43A having a flange at one end and having its opposite end portion screw threaded to receive a securing nut 44. Formed in the sleeve is a stepped cylinder in the narrower portion 46 of which is slidable a valve member 45. The nut 44 closes the wider portion of the cylinder and defined intermediate the narrower and wider portions of the cylinder is a step 47 against which is held a seating member 48. The seating member is held by a strong spring 49, against the step, the spring being located in the wider portion of the cylinder and interposed between the nut 44 and the seating member 48. The seating member is formed with a central drilling 50 and its annular end surface 51 remote from the spring forms a seating surface for engagement by the valve member.

The valve member 45 is of tubular form having a pair of flanges 52, 53 at its opposite ends, the outer surfaces of the flanges cooperate with the wall of the cylinder to guide the movement of the valve member. The flange 53 is provided with a series of spaced grooves to allow fuel flow to the space defined between the flanges and this flange also on its end face defines an annular seating rib 54 for engagement with the surface 51 to prevent flow of fuel from the low pressure fuel supply pump 20 to the bore 12. The operation of the valve shown in FIG. 4 is the same as the valve shown in FIGS. 2 and 3.

In order to monitor the operation of the inhibit valve 30 it is proposed when the operator of the engine turns the control key to stop the engine, to arrange that the control system remains active for a sufficient period of time to perform a test procedure. It is arranged that the spill valve 22 is re-closed at the end of inward movement of the pumping plungers and opened shortly after the commencement of the next inward movement so that the amount of fuel supplied to the associated engine will approximate to that required for engine idling. However, this period of spill valve closure is longer than would normally be the case and is long enough for the inhibit valve 30 to function as described to close off the supply of fuel to the pumping chamber of the high pressure pump and the engine should therefore stop. If it is detected that the engine idling speed is being maintained the control system stops the supply of current to the actuator 24 of the spill valve 22 which is therefore maintained in the open position and the supply of fuel to the engine is halted. The fact that the inhibit valve has failed to operate is noted in the diagnostics portion of the control system and a warning can be given to the operator at the next attempted engine start or restarting of the engine can be prevented.

I claim:

1. A fuel injection pumping apparatus for supplying fuel to a compression ignition engine comprising a bore (12), a pumping plunger (13) reciprocable within the bore, the bore and plunger defining a pumping chamber, an outlet passage (15) communicating with the pumping chamber and through which during inward movement of the pumping plunger, fuel can be displaced to an associated engine, passage means (19) through which fuel can flow from a source (20) of fuel under pressure to the pumping chamber to completely fill the pumping chamber during outward movement of the pumping plunger, an electromagnetically operable spill valve (22) including an actuating member (42), for spilling fuel from the pumping chamber during the inward movement of the plunger (13) thereby to control the quantity of fuel supplied to the associated engine, characterised by a flow inhibit valve (30) incorporated into said passage means (19), said flow inhibit valve including a valve member (36, 45) movable to a closed position to prevent flow of fuel through said passage means, and means (38) movable by said actuating member (42) for controlling the setting of said valve member whereby when the spill valve is in the closed position the valve member (36, 45) will move to the closed position.

2. An apparatus according to claim 1, characterised in that the valve member (36, 45) is biased by a spring (37) to the closed position and is movable to allow fuel flow along said passage means by the pressure of fuel from said source (20), said means (38) acting when the spill valve is closed, to balance the fuel pressure acting on the valve member to allow the valve member to move to the closed position under the action of said spring.

3. An apparatus according to claim 1, characterised in that the flow inhibit valve (30) comprises a cylinder (32, 46), a valve member (36, 45) slidable in the cylinder, a first port (33, 50) at one end of the cylinder and a second port (34) in the wall of the cylinder, said first port communicating with said source (20) and the ports and cylinder forming part of said passage means, a spring (37) biasing the valve member towards said one end of the cylinder, said valve member when in engagement with said one end of the cylinder preventing flow of fuel through said first port, a restricted passage (43) connecting the other end of the cylinder with said source (20) and said means (38) defining a control valve which is open to vent the other end of the cylinder when said spill valve is open.

4. An apparatus according to claim 3, characterised in that said control valve includes a control element (38) movable by said actuating member (42) to uncover an opening in the other end of the cylinder when said spill valve is open.

5. An apparatus according to claim 4, characterised in that said spring (37) is interposed between said control element and said valve member.

* * * * *